US007744066B2

(12) United States Patent
Williams

(10) Patent No.: US 7,744,066 B2
(45) Date of Patent: Jun. 29, 2010

(54) MECHANICAL AIR FUEL RATIO REGULATING CARBURETOR WITH FUEL PRESSURE REGULATION

(76) Inventor: Anthony John Williams, Eerste Zijweg 1, NL-3641 PD Mijdrecht (NL)

( * ) Notice: Subject to any disclaimer, the term of this patent is extended or adjusted under 35 U.S.C. 154(b) by 227 days.

(21) Appl. No.: 11/722,591

(22) PCT Filed: Aug. 18, 2005

(86) PCT No.: PCT/NL2005/000598

§ 371 (c)(1),
(2), (4) Date: Jun. 22, 2007

(87) PCT Pub. No.: WO2006/025727

PCT Pub. Date: Mar. 9, 2006

(65) Prior Publication Data

US 2008/0116594 A1 May 22, 2008

(30) Foreign Application Priority Data

Aug. 31, 2004 (NL) ..... 1026934
Dec. 22, 2004 (NL) ..... 1027853

(51) Int. Cl.
*F02M 7/18* (2006.01)

(52) U.S. Cl. ..... 261/44.2; 261/50.1; 261/59; 261/78.1

(58) Field of Classification Search ..... 261/44.2, 261/50.1, 59, 78.1
See application file for complete search history.

(56) References Cited

U.S. PATENT DOCUMENTS 1,104,560 A * 7/1914 Shoobridge et al. ..... 261/41.5
1,477,280 A * 12/1923 Pordes ..... 261/44.2
1,971,527 A * 8/1934 Kennedy ..... 261/44.2
2,004,003 A * 6/1935 Kennedy ..... 261/44.2
2,223,987 A * 12/1940 Firth ..... 261/34.2
2,801,086 A * 7/1957 Fish ..... 261/34.2
2,995,349 A * 8/1961 Kennedy, Sr. ..... 261/41.1
3,336,017 A * 8/1967 Kopa ..... 261/128
3,447,519 A * 6/1969 Marcik et al. ..... 123/73 AD
3,920,778 A 11/1975 De Rugeris
4,197,824 A * 4/1980 Holzbaur ..... 123/452
4,259,935 A * 4/1981 Watanabe et al. ..... 123/478

(Continued)

FOREIGN PATENT DOCUMENTS

DE 424 977 2/1926

(Continued)

*Primary Examiner*—Richard L Chiesa
(74) *Attorney, Agent, or Firm*—Oblon, Spivak, McClelland, Maier & Neustadt, L.L.P.

(57) ABSTRACT

A carburetor includes an air inlet with a mechanically adjustable air valve, a mechanically adjustable atomizer discharging in the air inlet, and a mechanical metering device connected with the air valve and the atomizer, maintaining a stoichiometric ratio between amounts of air and fuel. Additionally, the carburetor includes a fuel pressure regulating unit to regulate the fuel pressure of fuel injected in the air inlet, based on one or more dynamic engine load parameters under which a vacuum signal in the air inlet is obtained via a vacuum intake conduit discharging into the air inlet. By regulating the fuel pressure also in dependence of the measured vacuum signal, the emission of unburned fuel is reduced under certain dynamic conditions of the combustion engine.

14 Claims, 3 Drawing Sheets

U.S. PATENT DOCUMENTS

| | | | | | |
|---|---|---|---|---|---|
| 4,369,149 | A | * | 1/1983 | Violett | 261/44.2 |
| 4,526,729 | A | * | 7/1985 | Braun et al. | 261/36.2 |
| 4,572,809 | A | * | 2/1986 | Bothwell | 261/44.2 |
| 4,655,976 | A | * | 4/1987 | Buttner | 261/44.2 |
| 6,446,940 | B1 | * | 9/2002 | Berriman et al. | 261/41.1 |
| 2002/0060374 | A1 | * | 5/2002 | Berriman et al. | 261/78.1 |

FOREIGN PATENT DOCUMENTS

| | | | | | |
|---|---|---|---|---|---|
| GB | 5694 | | | 0/1914 | |
| GB | 115 823 | | | 6/1921 | |
| GB | 258 338 | | | 9/1926 | |
| GB | 2047797 | A | * | 12/1980 | 261/44.2 |
| GB | 2 131 876 | | | 6/1984 | |

* cited by examiner

MECHANICAL AIR FUEL RATIO REGULATING CARBURETOR WITH FUEL PRESSURE REGULATION

BACKGROUND OF THE INVENTION

I. Field of the Invention

The invention relates to a carburetor including an air inlet with a mechanically adjustable air valve, an atomiser coming into the air inlet, a metering device with the air valve and atomiser connected, often partly electronically made.

The invention also relates to a fuel engine, which is equipped with such a carburetor, on a vehicle equipped with the combustion engine and to a method whereby fuel is injected into the air inlet.

II. Description of Related Art

Carburetors and fuel engines are commonly known. Known are other carburetors for combustion engines with a great diversity of possible applications, and mostly based on the two or four-stroke principle. Carburetors and fuel engines have traction or industrial applications, varying from small to large capacities. The application depending design of the carburetor is then always a compromise between price, performance and for example manageability, maintenance, number of parts, vulnerability and such. Every application demands its own design of the carburetor, so that there is no question of exchangeability of a once made carburetor. Depending on the demanded application of the carburetor and the engine that goes with it, it is common to include a continuously increasing number of parameters in regulating the burning/combustion process of fuel and air, in an attempt to optimise this process per individual application.

This makes the known carburetor and similarly process operated devices more and more complex, reduces their exchangeability, increases the dependence of the necessary maintenance of the great number of parts, works price increasing, and reduces also the overall reliability.

BRIEF SUMMARY OF THE INVENTION

The aim of the invention is to provide a better, easy to make carburetor, with more universal application possibilities, which is less vulnerable and still regulates under all working conditions the right amounts of fuel and air.

To this end the carburetor according to the invention includes an air inlet with a mechanically adjustable air valve, a mechanically adjustable atomiser coming into the air inlet, and a mechanical metering device connected with the air-valve and the atomiser, maintaining a stoichiometric ratio between amounts of air and fuel.

The invention is based on the belief that not more parts and process parameters in the regulating should be taken in, but that to increase the efficiency of the burning of the fuel, the volumetric efficiency needs to be improved, so that under all working conditions, sufficient air is available within the complete reach of the engine, in which the carburetor is used. According to the invention, this aim is obtained by placing a direct, mechanical, metering device between the mechanical adjustable air valve and atomiser for the fuel that—once set—maintains a fixed stoichiometric ratio between the amounts air and fuel. In this way, or via this method, the available engine capacity for combustion can be used more effectively than before, for the benefit of creating or generating an increased brake mean effective pressure and thereby increased torque.

The carburetor according to the invention, with its reduced component parts is therefore simplified, has become more reliable, and as a consequence of the reduction of the number of moving parts, there is less maintenance required on the carburetor, according to the invention.

In an embodiment the metering device, which is a mechanically equipped metering device, is incorporated in the air inlet, through which the carburetor, according to the invention, also becomes more compact.

According to an embodiment of the invention, the spindle around which the air valve turns is made multiparted and hollow, thus a very simple design of the carburetor according to the invention is realised.

According to another embodiment of the invention, the atomiser comes into the air inlet at the foot of the air valve. This has the advantage that the fuel is led into such a position in the air inlet that a perfectly homogeneous atomisation takes place.

Another embodiment of the carburetor, according to the invention is characterised in that the air valve has grooves extending from its foot, and over the surface of the air valve. The fuel atomises uniformly from the grooves, thus also an optimum mixture takes place of fuel and air.

Further, the invention relates to a combustion engine and to a vehicle which is equipped with the above mentioned carburetor. Such an engine can take all known types of fuel, such as petrol, gas, diesel and any hydrocarbon compound.

Also the invention, in further detail, relates to a fuel injection method which is characterised in that the fuel pressure of the fuel injected into the air inlet is regulated and positive or negative changes in the air inlet are measured and are taken as a measure to regulate the fuel pressure, whereby, in a differentiation of this, the change at the exit point of fuel in the air inlet is measured.

The method, according to the invention, provides the possibilities under certain dynamic conditions of the combustion engine in a vehicle, in which for example, a large quantity of unburned fuel is emitted, to modulate the fuel pressure, more specifically to reduce it, and therefore reduce the harmful emissions.

BRIEF DESCRIPTION OF THE DRAWINGS

The carburetor, the combustion engine and the fuel injection method of the invention will be further explained, with the aid of the figures, in which similar parts are encircled with reference numbers.

DETAILED DESCRIPTION OF THE INVENTION

Figure 1:
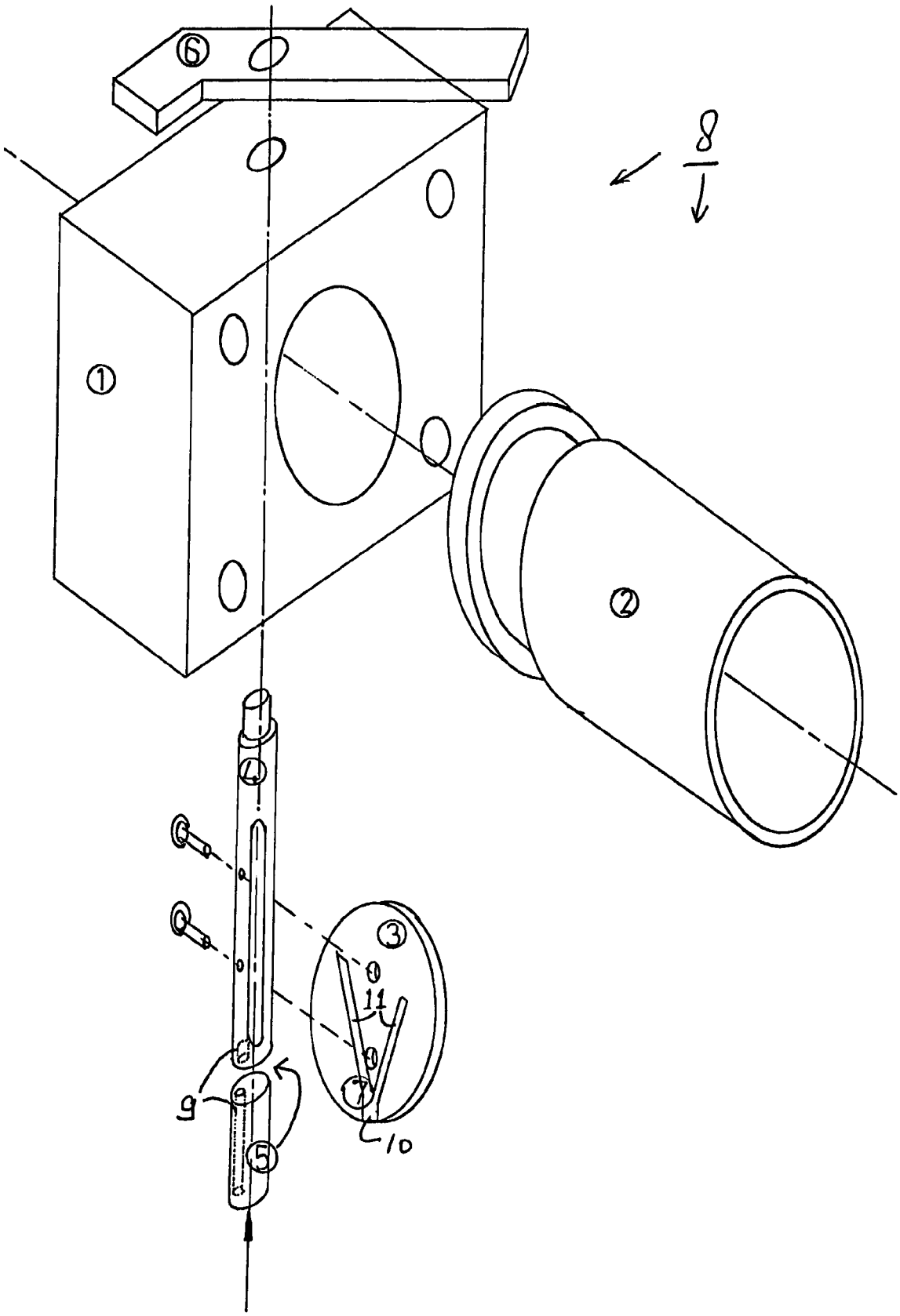
FIG. 1 is a description/drawing of the carburetor according to the invention.
Figure 2:
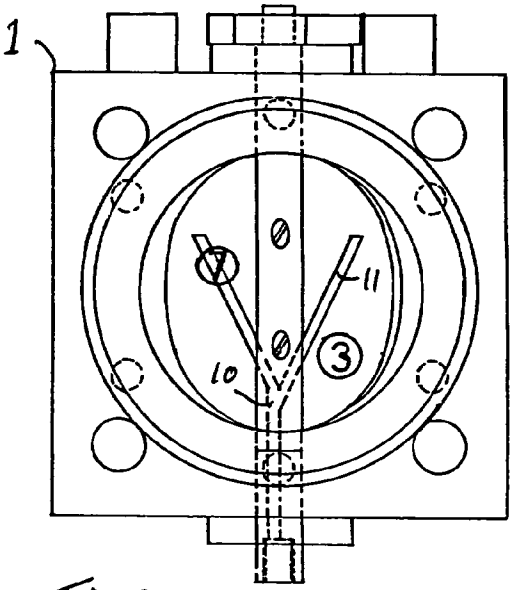
FIGS. 2, 3 and 4 are drawings of right, back and top of the carburetor of FIG. 1.
Figure 3:
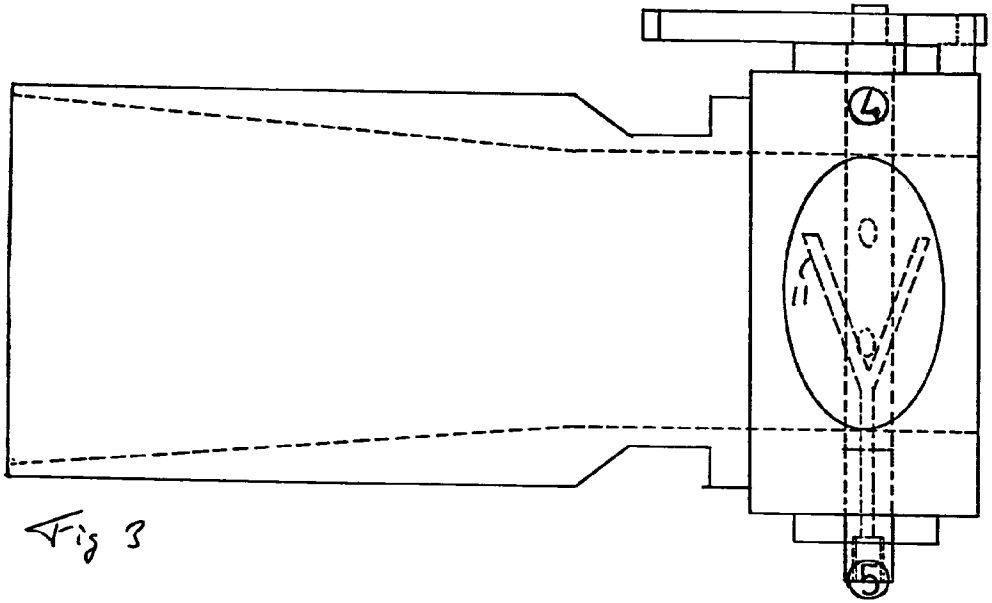
Figure 4:
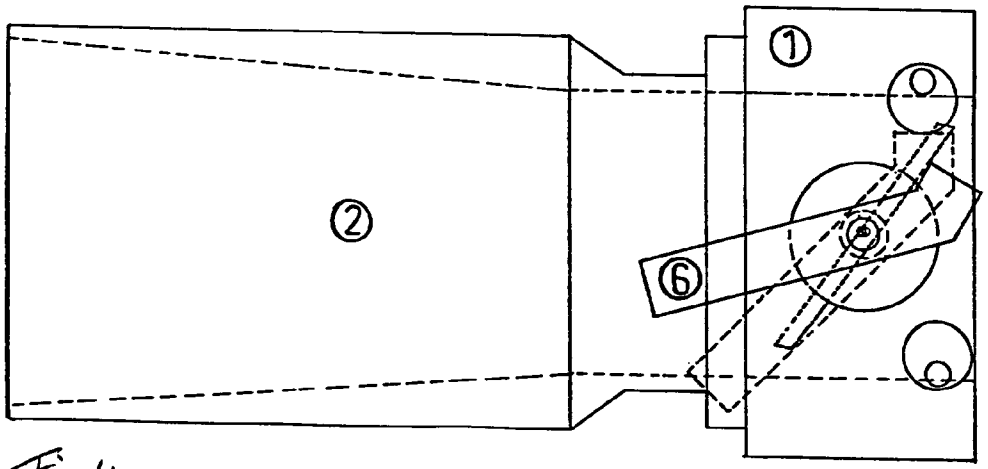

The FIGS. 1, 2, 3 and 4 show a valve block 1, an air inlet 2, in which is situated an air valve 3, which is turnable around a multiparted spindle 4, which is part of a mechanical metering device, a fuel valve 5, which is situated on the partition surface, which serves as metering device, on the multiparted spindle 4, a lever 6 connected on the top part of the spindles 4, and grooves 7, which can be engraved on the surface of the air valve 3. The parts 1-7 form the main parts of a schematically presented carburetor 8, which is purely mechanical. Through the fixed mechanical coupling, in the form of the metering device 4, in all pressure situations and applications, at each with the lever 6 set position of the fuel valve 5, a stoichiometric ratio between the amounts air and fuel is maintained. The carburetor 8 assures with a near unobstructed flow of air through the air inlet 2, then, at all times, for an optimum volumetric efficiency, through which, without further necessary accessories, under all dynamic conditions, a better efficiency is obtained.

The metering device 4 concentrates around the air inlet 2 incorporated multifunctional spindle 4, whereby the air valve 3 is fitted in the upper turnable spindle shown in FIG. 1. The moveable upper spindle part forms with the lower fixed spindle part shown in FIG. 1, the fuel regulating valve 5, in a fuel conduit 9, which goes partly through the hollow parts of the spindle 4. The amount of fuel which is let in, through the valve 5, into the air inlet 2, is therefore, via the angular position of the spindle 4, and the air valve 3, precisely, stoichiometrically related to the amount of air that passes the valve 3. The fuel conduit, with a desired diameter 9 will therefore be mostly eccentric in the respective spindle parts of the multiparted spindle 4.

The part of the fuel conduit 9 situated in the upper spindle part of the multiparted spindle 4, comes into the air inlet 2, at the foot 10, of the air valve 3. The air valve 3, from the foot 10, over the surface of the air valve 3, can have grooves 11, through which a homogenous mixture of fuel and air comes about, which atomised uniformly, can be guided, via the air inlet 2, to the engine.

The herein described method, can simply be combined with methods to vary the pressure of the fuel to the fuel valve 5, if desired in dependence of one or more thermodynamic engine pressure parameters. Fine tuning of parameters, such as, for example the fuel pressure, and/or the fuel volume can subsequently take place, with the aid of vacuum, hydraulic, pneumatic, or suitable mechanics.

A practical advantage of the invention is the absence of a fuel reservoir in the carburetor 8, and therefore the absence of a float and needle, which has as a further positive result that the carburetor 8 can be placed and used in any desired position, vertical, upside down, or on its side. Therefore, problems in relation to that construction, are undermined, for example, a shortage of fuel at the occurrence of large G-forces, such as those occurring, in racing with a wide variation of dynamic forces and also a possibility that too much fuel which can also be the consequence of such big G-forces. Also, there are no longer problems with floats and needles or evaporation of fuel (dampslot) on the spot which is caused by high temperatures in the combustion space and the engine.

If desired, mostly depending on the load process and the application of the engine in question, several carburetors 8 can be connected parallel to one another to provide one or more combustion spaces with the desired fuel air mixture.

Figure 5:
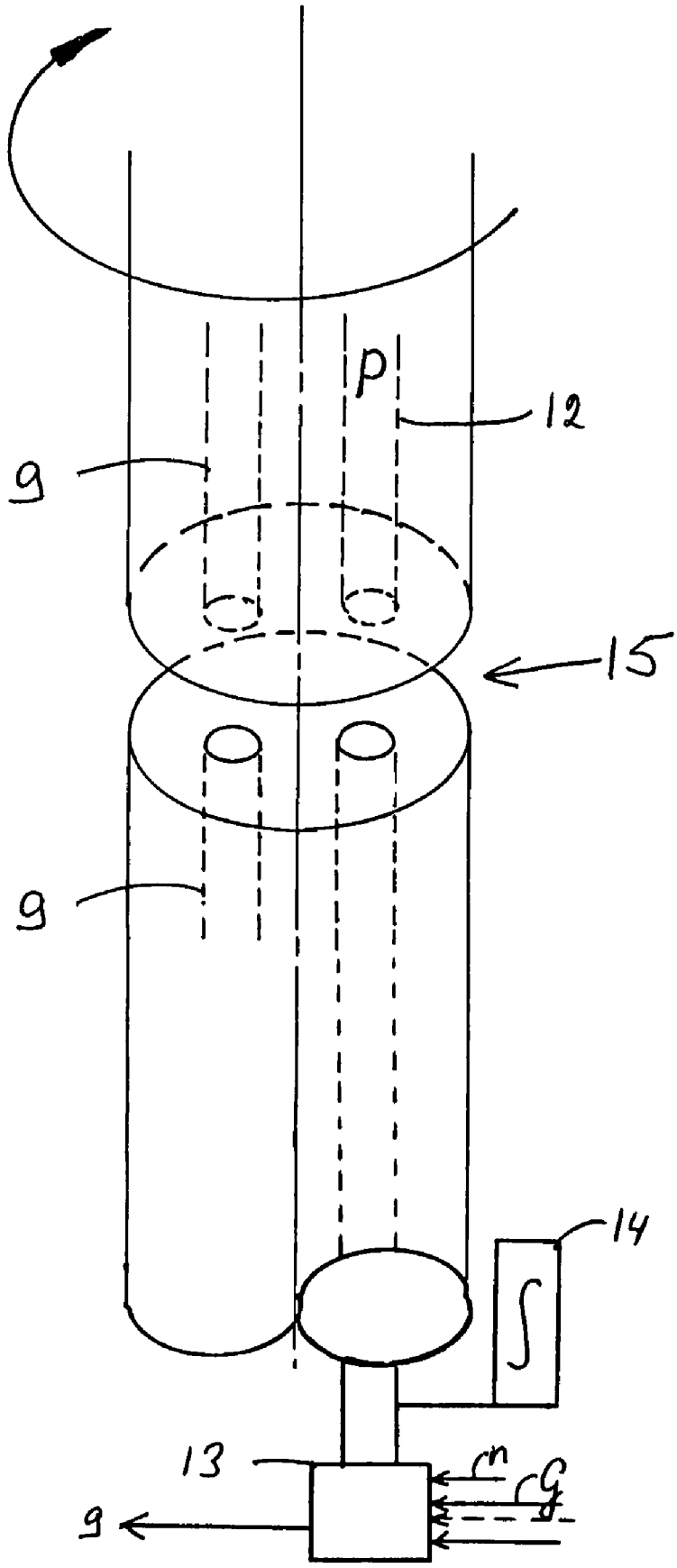
FIG. 5 is a detail of a multiparted spindle which is equipped with a fuel conduit and a vacuum-intake conduit and which is suitable for application in the carburetor according to the FIGS. 1-4.

FIG. 5 shows the multifunctional spindle 4, which, in this embodiment, is equipped with two conduits, fuel conduit 9 and a vacuum intake conduit 12. In a preferred embodiment, fuel pressure regulating means/devices 13 are equipped to regulate the fuel pressure of the injected fuel in the air inlet 2. More particular, the fuel pressure is influenced in dependence of the pressure P in the air inlet 2, more specifically, through measuring that pressure, via the vacuum intake conduit 12. The vacuum intake conduit 12 comes into the air inlet 2, preferably in the proximity of the exit point of the fuel into the air stream. By this method the fuel pressure can be adapted by the means/devices 13 to the dynamic conditions of the combustion engine. If, for example, a driver in a high gear G in a car, with low engine speed n, gives a lot of gas, a great amount of unburned hydrocarbons from the fuel, will be released via the exhaust into the environment. This will stay the case, until the engine has developed sufficient speed to totally atomise the fuel present in the venturi, and then to burn the fuel air mixture. By limiting (in this case by low engine speed n, in particular at a high gear G, the fuel pressure), the undesired emission is stopped.

In general under all dynamic conditions, the fuel pressure regulation, can, with the right metering information, for the fuel pressure regulating devices 13, as additional trimming device, be used, to obtain complete combustion as "perfect" as possible.

Additionally, the carburetor 8, can be equipped with a fuel damping/delay valve 14, mostly in the vacuum intake conduit. The fuel damping/delay valve 14 assures that small pressure variations in the venturi, which, via the intake conduit 12, in the air inlet, are being measured, are being smoothed, and are being mathematically integrated, by which also a desired delay time in the fuel pressure regulating/metering is introduced.

In FIG. 5, the fuel valve controls the fuel supply via the fuel conduit 9, as earlier explained. If so wished, a measure, for the fuel supply via the valve 5, can also be given to the pressure in the intake conduit 12. The diameter of the conduit 12 can, to this purpose, be made parabolic, by making this, for example elliptic, or by bringing in another suitable shape of the diameter on the spot of the partition surface 15 of the fuel valve 5, between the (to be more clear, drawn here at a distance from each other), spindle parts of the spindle 4.

The fuel pressure regulation can, if desired, also independently be applied from the specific carburetor design with multipartite spindle 4 and/or conduits 9 and 12. Also, a form of gravity, or movement force guided fuel pressure regulation, can take place, or the fuel can be sucked via underpressure.

The carburetor can be made, at least partly for example, through moulding in plastic or aluminium.

The invention claimed is:

1. A carburetor, comprising:

an air inlet with a mechanically adjustable air valve;

a mechanically adjustable atomiser discharging in the air inlet;

fuel pressure regulating means connected to a fuel valve for regulating a fuel pressure of fuel injected in the air inlet and connected to a vacuum sensing conduit discharging into the air inlet; and a mechanical metering device coupled with the air valve and the atomiser, the metering device including a multipartite spindle having a plurality of spindle parts which are mutually rotatable, wherein the air valve is pivotable around one spindle part, and the multipartite spindle includes a fuel conduit leading to the atomiser such that an amount of fuel running through the fuel conduit to the atomiser is controllable by rotating the one spindle part, in proportion with an amount of air allowed to pass, relative to an other spindle part for maintaining a stoichiometric ratio between amounts of air and fuel.

2. The carburetor according to claim 1, wherein the metering device is a solely mechanically equipped metering device.

3. The carburetor according to claim 1, wherein the fuel conduit is situated eccentrically in respective spindle parts of the multipartite spindle.

4. The carburetor according claim 1, wherein one of the spindle parts is fixedly mounted in the carburetor.

5. The carburetor according to claim 1, wherein the atomiser discharges into the air inlet at a foot of the air valve.

6. The carburetor according to claim 5, wherein the air valve includes grooves extending from the foot over a surface of the air valve.

7. The carburetor according to claim 1, wherein the fuel pressure regulating means influence the fuel pressure according to one or more combustion or engine load/pressure parameters including a vacuum pressure in the air inlet.

8. The carburetor according to one of the claim 1, wherein the metering device includes the multipartite spindle which is provided with a vacuum sensing/intake conduit leading to the air inlet.

9. The carburetor according to claim 8, wherein the carburetor is provided with a flow damping/delay valve connected to the vacuum intake conduit.

10. The carburetor according to claim 1, wherein the metering device includes the multipartite spindle such that the air valve around one spindle part is made turnable, the multipartite spindle includes the fuel conduit leading to the atomiser and/or the vacuum sensing conduit leading to the air inlet, and the multipartite spindle includes spindle parts that between themselves are turnable.

11. A combustion engine equipped with the carburetor according to claim 1.

12. A vehicle including the combustion engine according to claim 11.

13. A method, comprising the steps of:

injecting a controlled amount of fuel into the air inlet of the carburetor according to claim 1, measuring a fuel pressure in the air inlet; and regulating the fuel pressure of the air inlet to stop undesired emissions.

14. The method according to claim 13, wherein the pressure on a point of exit of the fuel into the air inlet is measured.

* * * * *

UNITED STATES PATENT AND TRADEMARK OFFICE

CERTIFICATE OF CORRECTION

PATENT NO. : 7,744,066 B2
APPLICATION NO. : 11/722591
DATED : June 29, 2010
INVENTOR(S) : Williams It is certified that error appears in the above-identified patent and that said Letters Patent is hereby corrected as shown below:

On the title page, Item (86), the PCT information, and Item (30), the Foreign Application Priority Data are incorrect. Items (86) and (30) should read:

-- (86) PCT No.: PCT/NL2005/000598

§ 371 (c)(1),
(2), (4) Date: Oct. 15, 2007

(30) Foreign Application Priority Data

Dec. 22, 2004 (NL) ..... 1027853 --

Signed and Sealed this

Twenty-fourth Day of August, 2010

David J. Kappos

David J. Kappos
*Director of the United States Patent and Trademark Office*